US008505177B2

(12) United States Patent
Chen

(10) Patent No.: US 8,505,177 B2
(45) Date of Patent: Aug. 13, 2013

(54) REMOVAL AND REPLACEMENT TOOL FOR VEHICLES

(76) Inventor: Jun Fan Chen, Taichung (TW)

( * ) Notice: Subject to any disclaimer, the term of this patent is extended or adjusted under 35 U.S.C. 154(b) by 416 days.

(21) Appl. No.: 12/972,582

(22) Filed: Dec. 20, 2010

(65) Prior Publication Data

US 2012/0151729 A1 Jun. 21, 2012

(51) Int. Cl.
*B25B 27/14* (2006.01)

(52) U.S. Cl.
USPC ..... 29/270; 29/239; 269/3; 269/6

(58) Field of Classification Search
USPC ..... 29/239, 270, 257, 268; 269/3, 6, 269/95
See application file for complete search history.

(56) References Cited

U.S. PATENT DOCUMENTS 6,678,931 B1 * 1/2004 Tatasciore ..... 29/239
6,874,217 B2 * 4/2005 Ploeger et al. ..... 29/239
7,155,792 B1 * 1/2007 Miller, Jr. ..... 29/239
8,276,251 B2 * 10/2012 Mitchell ..... 29/239
8,393,063 B2 * 3/2013 Hodges et al. ..... 29/239
2004/0123438 A1 * 7/2004 Kang ..... 29/239
2012/0151729 A1 * 6/2012 Chen ..... 29/270
2012/0204393 A1 * 8/2012 Gentner et al. ..... 29/257

* cited by examiner

*Primary Examiner* — Lee D Wilson
(74) *Attorney, Agent, or Firm* — Alan Kamrath; Kamrath IP Lawfirm, P.A.

(57) ABSTRACT

A removal and replacement tool for vehicles contains a first body including a chamber, a second hole, and a third hole; a grip set including a second body and a push piece, the push piece including an arcuate notch; at least one first returning spring, one end of which is fixed in the chamber, and another end of which abuts against two sides of the second body; a shaft member disposed in the chamber, and its one end extending out of the first body from the first hole; a second spring, one end of which abuts against the chamber, another end of which is biased against the shaft member; an engaging member including a first side wall and a second side wall; a rotary knob including a rotating portion and a rod portion connecting with the rotating portion.

6 Claims, 10 Drawing Sheets

REMOVAL AND REPLACEMENT TOOL FOR VEHICLES

BACKGROUND OF THE INVENTION

1. Field of the Invention

The present invention relates to a removal and replacement tool for vehicles in accordance with the present invention is used to repair and maintain vehicles, such as removing or replacing a wheel cylinder, a brake shoe, and a piston etc.

2. Description of the Prior Art

A conventional removal and replacement tool for vehicles disclosed in TW. Pub. No. 566290 includes a screwing post, an abutting plate inserted in the screwing post, a pushing member screwed with the screwing post, and a guiding shank inserted into the abutting plate and the pushing member, wherein the abutting plate and the pushing member contact with an end surface of a piston, and the screwing post is rotated so that the abutting plate and the pushing member push the piston, replacing the piston.

However, such an operation has to rotate the screwing post manually to further push the abutting plate and the pushing member to move axially, it is time and force consuming to operate the removal and replacement tool.

The present invention has arisen to mitigate and/or obviate the afore-described disadvantages.

SUMMARY OF THE INVENTION

The primary object of the present invention is to provide a removal and replacement tool for vehicles of which the shaft member is pushed by the second spring to move toward the chamber so that the second retaining member engages with the first retaining member tightly, lowering a store size.

Further object of the present invention is to provide a removal and replacement tool for vehicles of which the second body is pressed to push the shaft member to move outward so that the second retaining member moves away from the first retaining member, operating the removal and replacement tool easily and quickly.

Another object of the present invention is to provide a removal and replacement tool for vehicles of which the rotating portion of the rotary knob is rotated toward the returning position so that the second spring pulls the shaft member backward quickly, thereby returning the shaft member easily.

The present invention is to provide a removal and replacement tool for vehicles contains:

a first body including a chamber, a first hole disposed on one side thereof, a second hole fixed on a bottom end thereof, and a third hole formed thereon;

a grip set including a second body and a push piece, and one side of the second body being axially fixed in the chamber of the first body, another side of the second body being extended out of the first body from the second hole, and the push piece including an arcuate notch arranged on a top end thereof;

at least one first returning spring, one end of which abut against the first body, and another end of which abuts against the second body;

a shaft member disposed in the chamber of the first body, and its one end extending out of the first body from the first hole;

a second spring, one end of which abuts against the chamber of the first body, another end of which is biased against the shaft member so that when the shaft member is not forced, the second spring provides a predetermined pull force to the shaft member to move toward the chamber;

an engaging member including a first side wall and a second side wall, and the first side wall including a first aperture disposed thereon, the second side wall including a second aperture fixed thereon, wherein the engaging member is fixed in the chamber of the first body, and the first and the second apertures are used to insert the shaft member therein;

a first retaining member secured on the first body;

a second retaining member retained with the shaft member and actuated by the shaft member;

a rotary knob including a rotating portion and a rod portion connecting with the rotating portion, and the rotating section being located outsides the first body and forced to move between a retaining position and a limiting position, the rod portion including at least one flat face and at least one arcuate faces and being inserted into the chamber from the first hole of the first body.

DETAILED DESCRIPTION OF THE PREFERRED EMBODIMENTS

Figure 1:
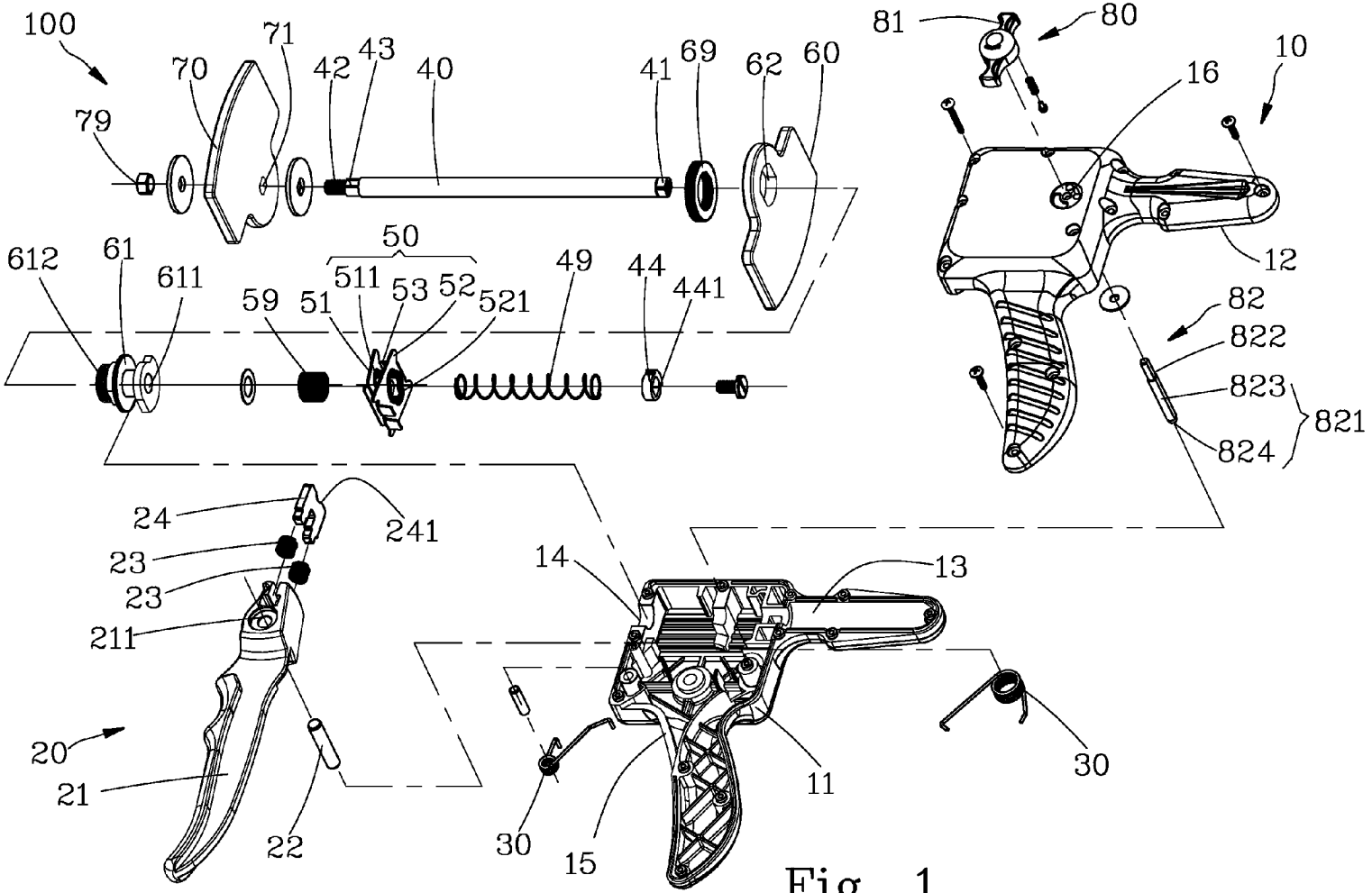
FIG. 1 is a perspective view showing the exploded components of a removal and replacement tool for vehicles in accordance with the present invention.

The present invention will be clearer from the following description when viewed together with the accompanying drawings, which show, for purpose of illustrations only, the preferred embodiment in accordance with the present invention.

Referring to FIGS. 1-11, a removal and replacement tool 100 for vehicles in accordance with the present invention is used to repair and maintain vehicles, such as removing or replacing a wheel cylinder, a brake shoe, and a piston etc., and comprises: a first body 10, a grip set 20, two first returning springs 30, a shaft member 40, a second spring 49, an engaging member 50, a third spring 59, a first retaining member 60, a second retaining member 70, and a rotary knob 80.

Figure 2:
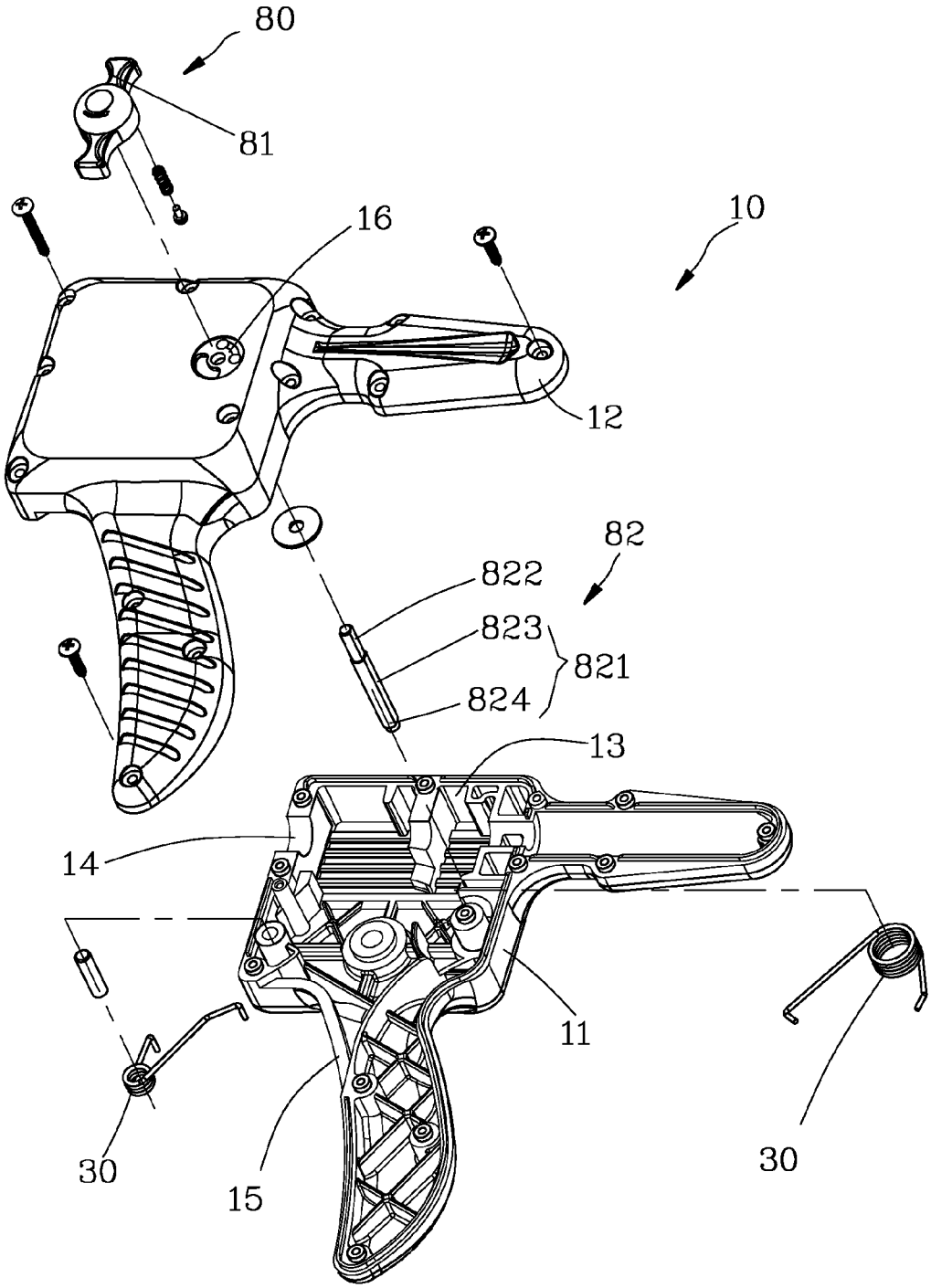
FIG. 2 is a perspective view showing the exploded components of a first body and a rotary knob of the removal and replacement tool for vehicles in accordance with the present invention.
Figure 6:
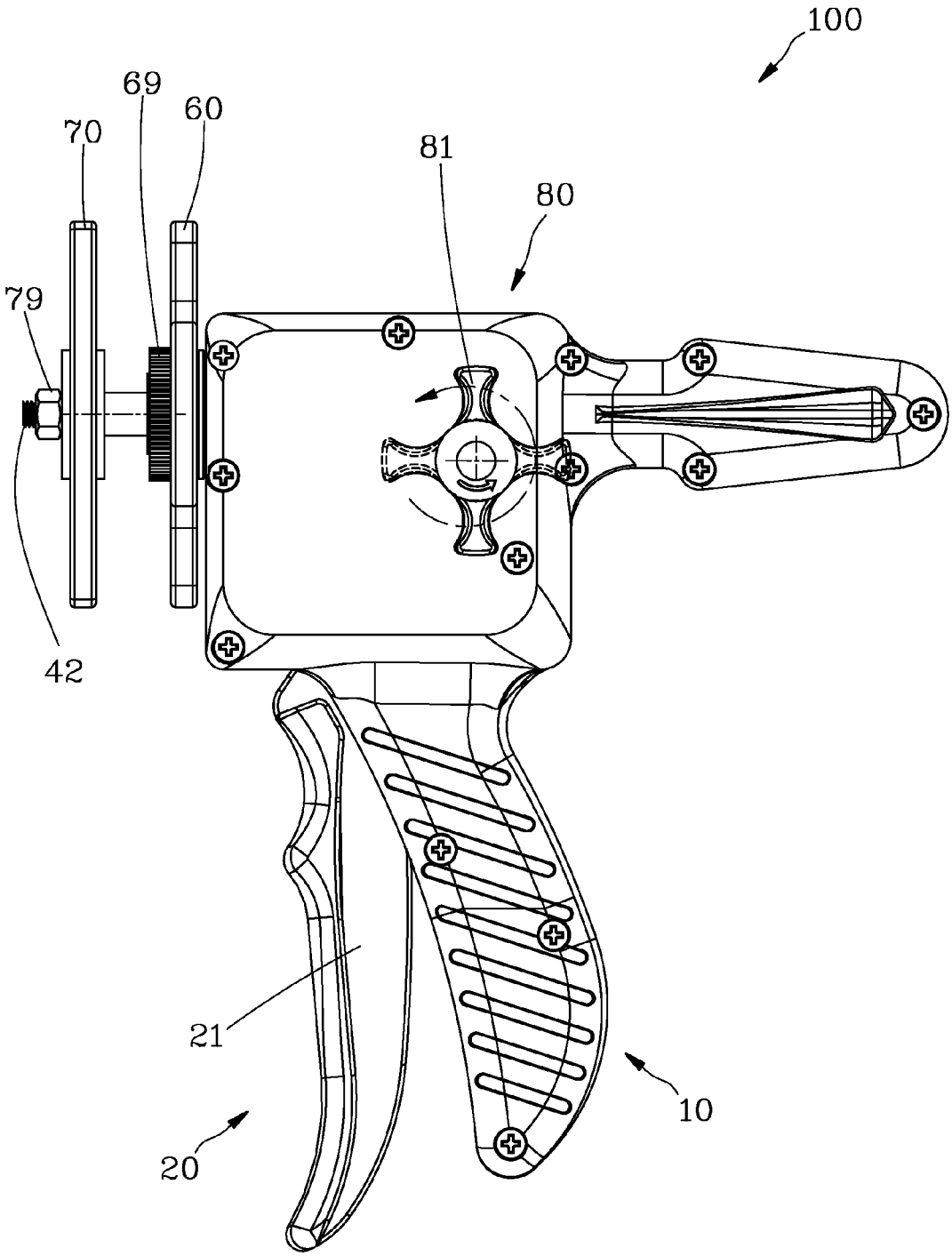
FIG. 6 is a side plan view showing the operation of the removal and replacement tool for vehicles in accordance with the present invention.

As shown in FIGS. 1, 2, and 6, a first body 10 includes a first housing 11, a second housing 12, a chamber 13, a first hole 14 disposed on one side thereof to insert the shaft member 40 therein, a second hole 15 fixed on a bottom end thereof, and a third hole 16 formed thereon.

Figure 3:
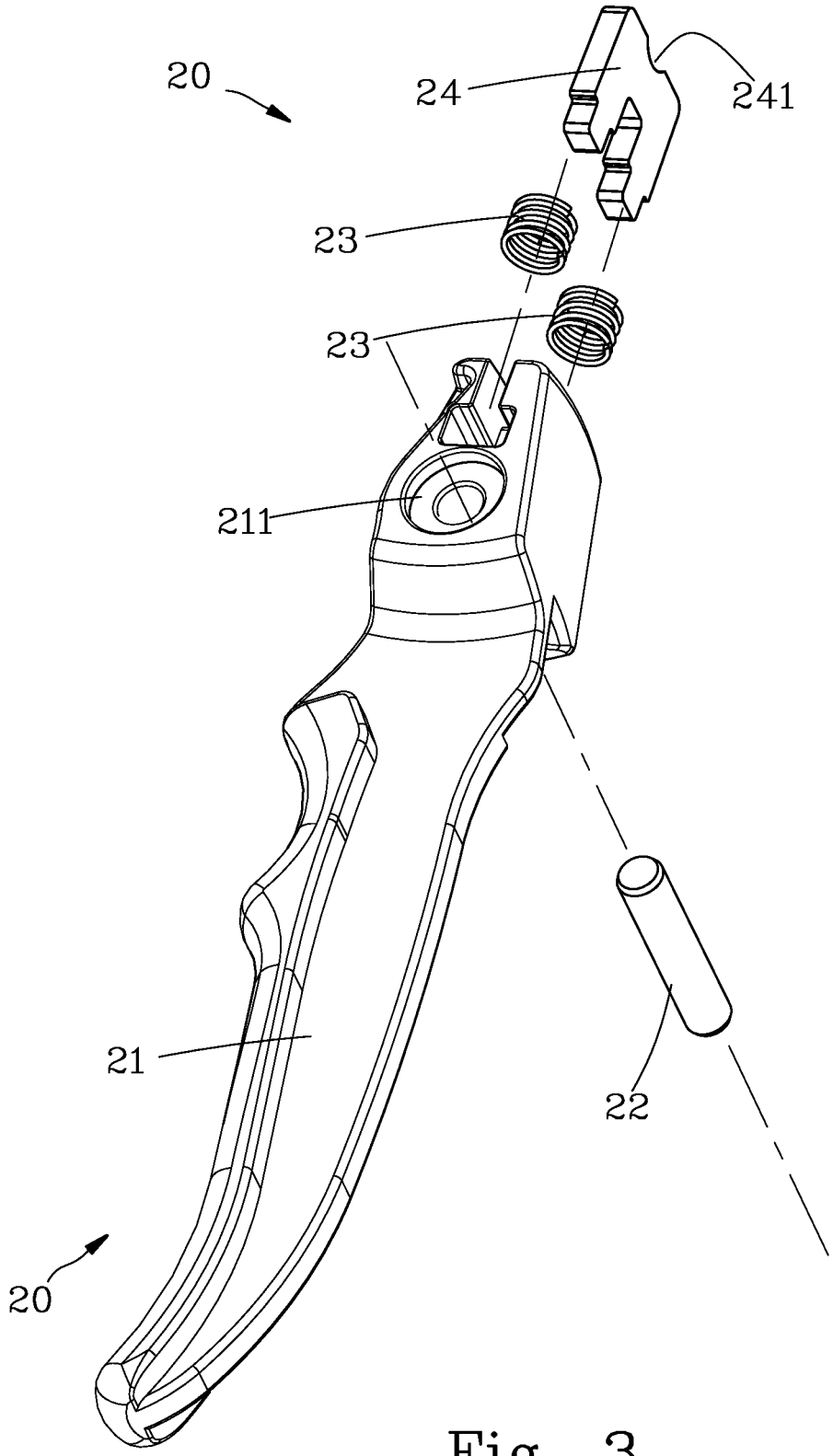
FIG. 3 is a perspective view showing the exploded components of a grip set of the removal and replacement tool for vehicles in accordance with the present invention.
Figure 5:
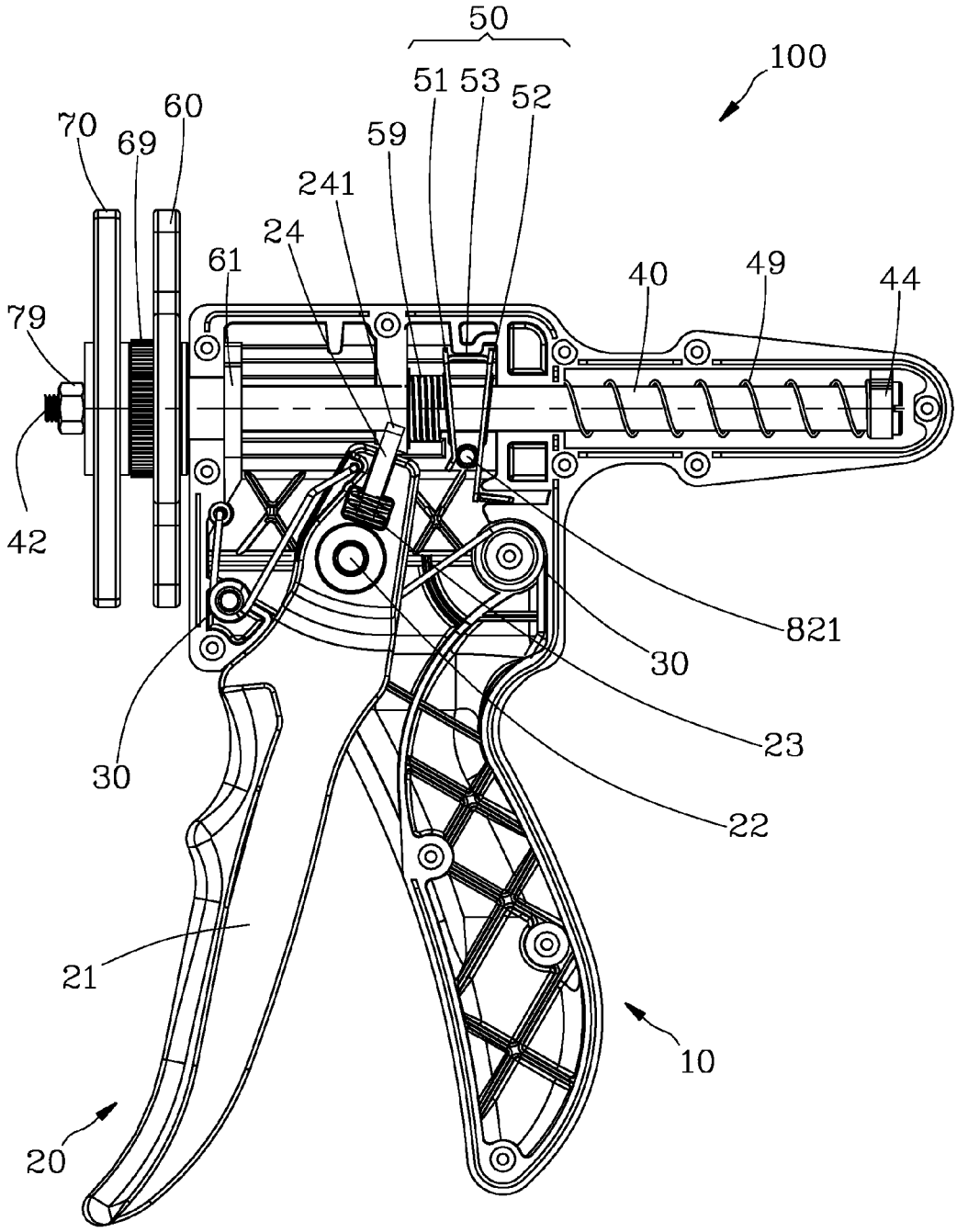
FIG. 5 is a cross sectional view showing the assembly of the removal and replacement tool for vehicles in accordance with the present invention.
Figure 8:
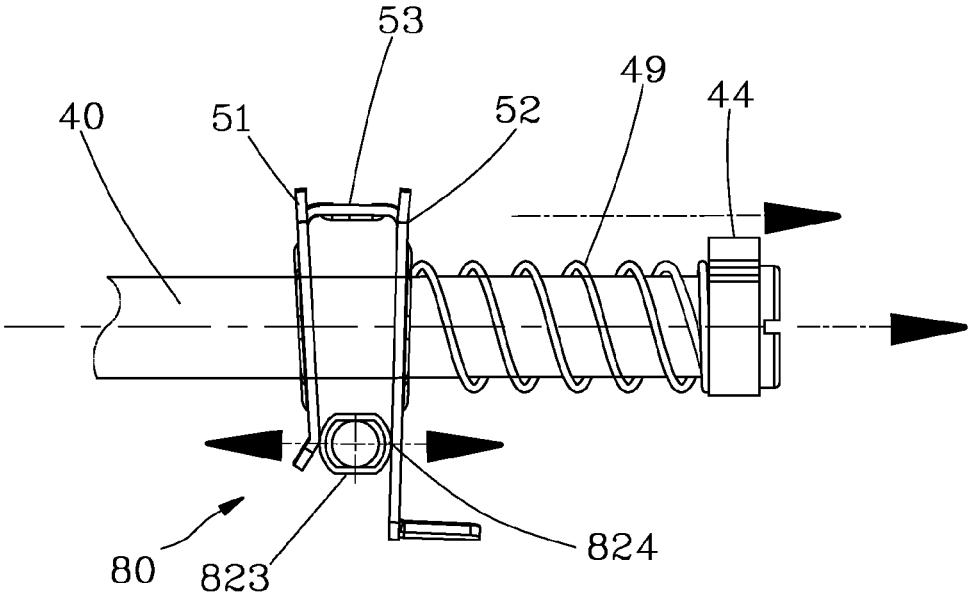
FIG. 8 is another side plan view showing the operation of the removal and replacement tool for vehicles in accordance with the present invention.

As illustrated in FIGS. 1, 3, and 5, the grip set 20 includes a second body 21, an axial stem 22, two pushing springs 23, and a push piece 24; the second body 21 includes a bore 211 to insert the axial stem 22 therein, and one side of the second body 21 is axially fixed in the chamber 13 of the first body 10 so that the second body 21 is released and pressed by using the axial stem 22 as shown in FIGS. 5 and 8 respectively; another side of the second body 21 is extended out of the first body 10 from the second hole 15, and the pushing springs 23 are disposed in the chamber 13, a bottom end of the push piece 24 connects with the pushing springs 23 to obtain an upward resilience, and the push piece 24 includes an arcuate notch 241 arranged on a top end thereof.

Referring to FIGS. 1, 2, and 5, one end of each first returning spring 30 is fixed in the chamber 13 of the first body 10, and another end thereof abuts against two sides of the second body 21 so that when the second body 21 is not forced, the first returning spring 30 pushes the second body 21 to a releasing position as illustrated in FIG. 5.

Figure 4:
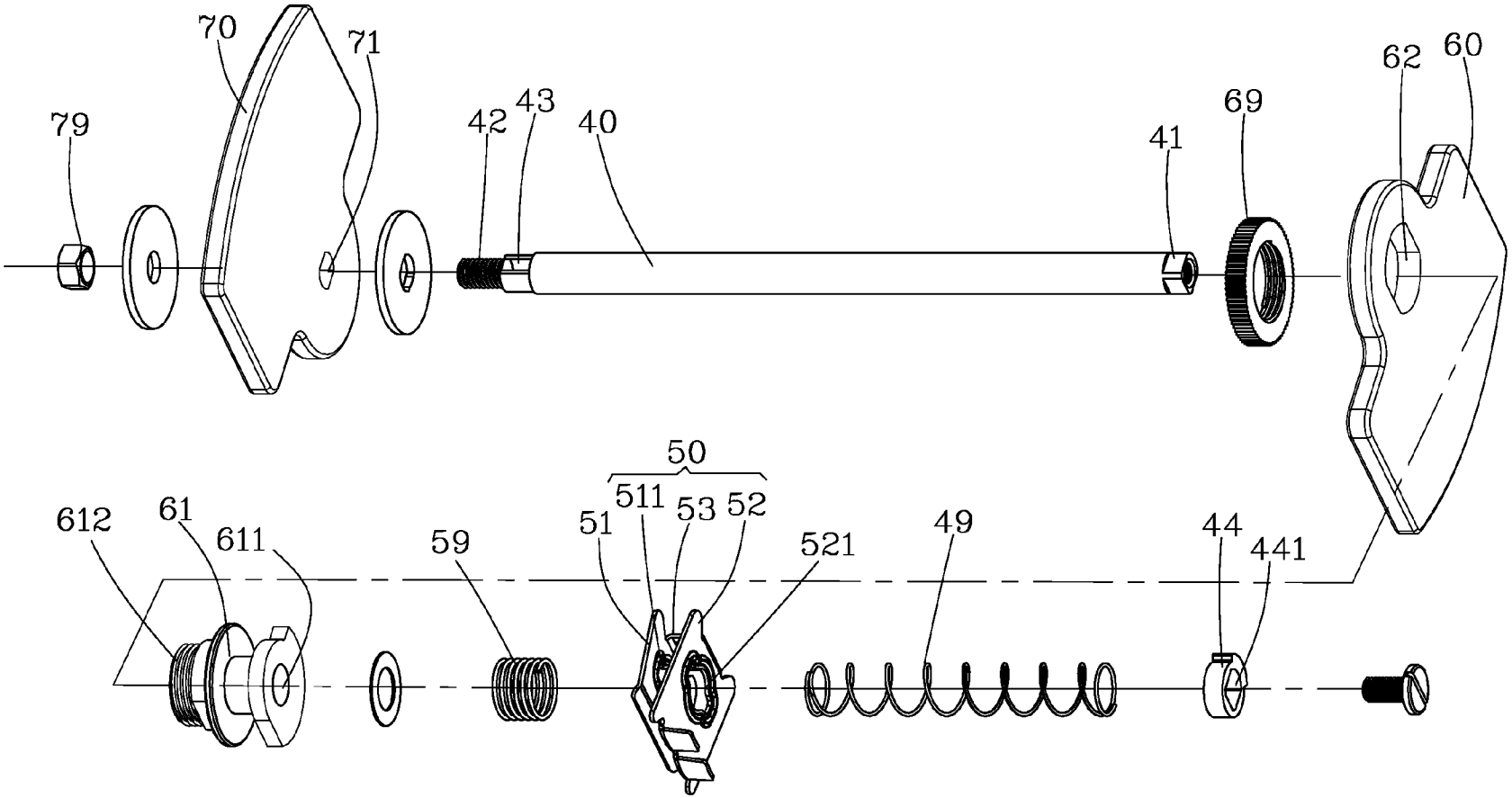
FIG. 4 is a perspective view showing the exploded components of a shaft member and an engaging member of the removal and replacement tool for vehicles in accordance with the present invention.

With reference to FIGS. 1, 4, and 5, the shaft member 40 is disposed in the chamber 13 of the first body 10, and its one end extends out of the first body 10 from the first hole 14 so as to be forced to move reciprocately, and the shaft member 40 includes a positioning portion 41, a cross section of which is formed in a rectangle shape, and includes a screwing portion 42 arranged on the one end thereof extending out of the first body 10, and includes a limiting portion 43 fixed thereon adjacent to the screwing portion 42, and a cross section of the limiting portion 43 is formed in a rectangle shape as well.

One end of the second spring 49 abuts against the chamber 13 of the first body 10, another end thereof is biased against the positioning portion 41 of the shaft member 40 so that when the shaft member 40 is not forced, the second spring 49 provides a predetermined pull force to the shaft member 40 to move toward the chamber 13.

The engaging member 50 includes a first side wall 51, a second side wall 52, and a connecting wall 53 to connect with the first side wall 51 or the second side wall 52, and the first side wall 51 includes a first aperture 511 disposed thereon, the second side wall 52 includes a second aperture 521 fixed thereon, wherein the engaging member 50 is fixed in the chamber 13 of the first body 10, and the first and the second apertures 511, 521 are used to insert the shaft member 40 therein.

The third spring 59 is disposed in the chamber 13 of the first body 10, and its one end contacts with an inner surface of the chamber 13, it's another end is biased against the first side wall 51 of the engaging member 50 so that when the first and the second apertures 511, 521 of the first and the second side walls 51, 52 are not forced, they are at a tilted angle relative to the shaft member 40 so that the shaft member 40 only allows to axially move toward the first hole 14 without moving toward the chamber 13.

The first retaining member 60 is secured on the first body 10 by using a sleeve 61 fitted onto the first hole 14, and includes a first orifice 62 to fit the sleeve 61 therein, the sleeve 61 includes an opening 611 to insert the shaft member 40 therein.

The second retaining member 70 includes a second orifice 71 formed in a rectangle shape to correspond to a profile of the limiting portion 43 of the shaft member 40, and the second orifice 71 is applied to insert the limiting portion 43 of the shaft member 40 therein, the limiting portion 43 is screwed with the screwing portion 42 of the shaft member 40 so that the second retaining member 70 is retained with the limiting portion 43 of the shaft member 40 to prevent the second retaining member 70 from rotation relative to the shaft member 40.

Figure 7:
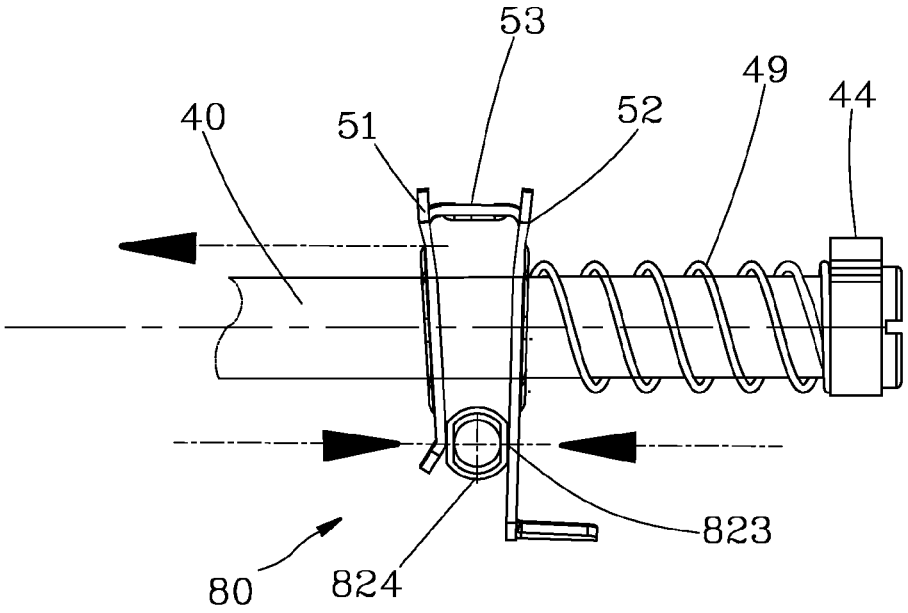
FIG. 7 is another side plan view showing the operation of the removal and replacement tool for vehicles in accordance with the present invention.

As illustrated in FIGS. 1 and 5-7, the rotary knob 80 includes a rotating portion 81 and a rod portion 82 connecting with the rotating portion 81, and the rod portion 82 including an acting section 821 and a coupling section 822 integrally connecting with the acting section 821, and the acting section 821 is inserted into the chamber 13 from the third hole 16, and the coupling section 822 is located outsides the third hole 16 to connect with the rotating portion 81, the rotating portion 81 is held by a user's fingers and moves between a retaining position and a limiting position (as show in FIG. 6), the acting section 821 is defined between the first and the second side walls 51, 52 of the engaging member 50, and the acting section 821 includes two symmetrical flat faces 823 and two symmetrical arcuate faces 824; under a normal condition, the rotating portion 81 is located at the limiting position, and the flat faces 823 contact with the first and the second side walls 51, 52 respectively (as shown in FIG. 7) so that the tilted angle is kept among the first aperture 511, the second aperture 521, and the shaft member 40.

Figure 9:
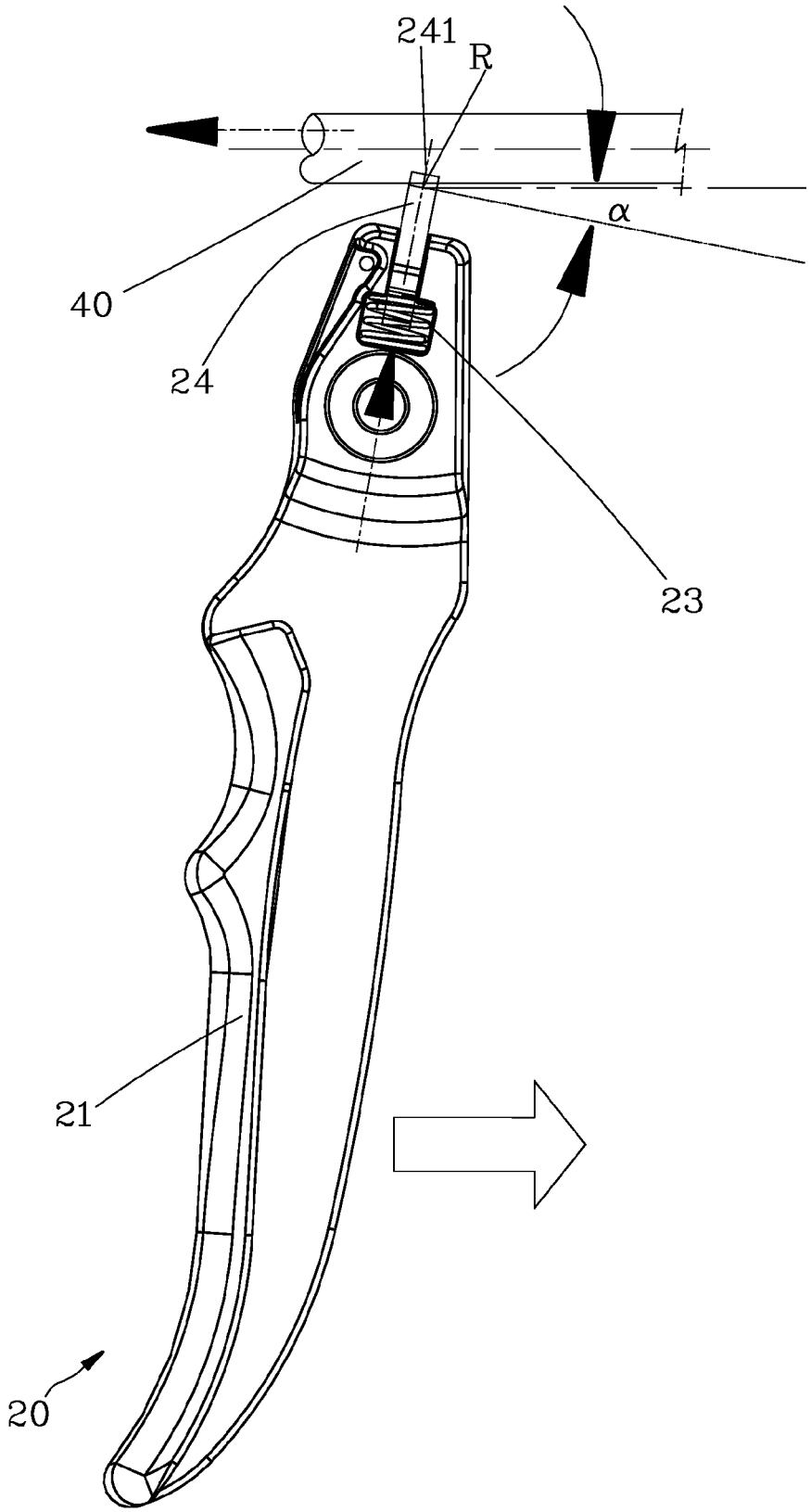
FIG. 9 is also another side plan view showing the operation of the removal and replacement tool for vehicles in accordance with the present invention.
Figure 10:
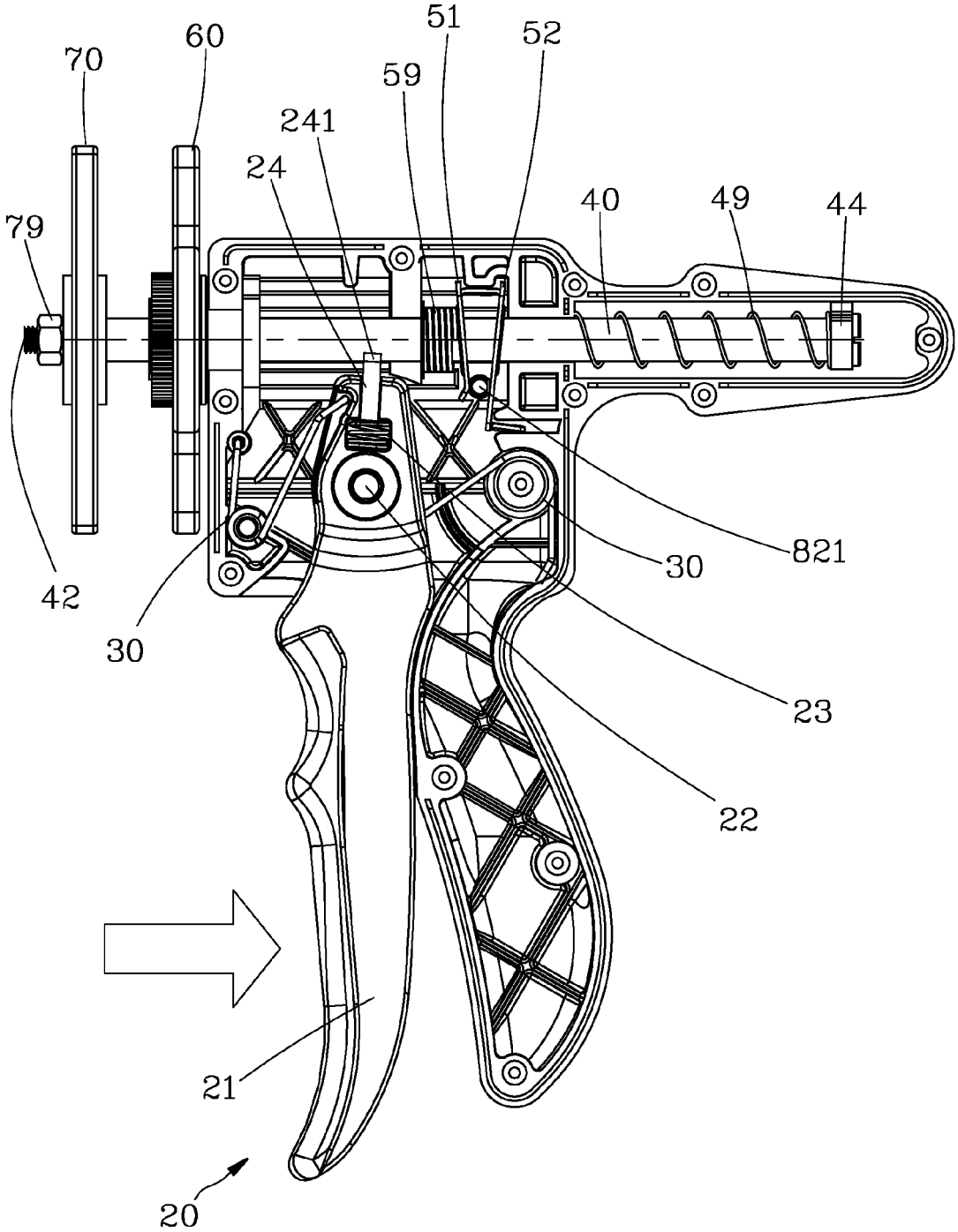
FIG. 10 is another side plan view showing the operation of the removal and replacement tool for vehicles in accordance with the present invention.

Thereby, the removal and replacement tool 100 is used to repair and maintain vehicles. For example, the rotating portion 81 of the rotary knob 80 is kept at the limiting position represented by a solid line in FIG. 6 so that the flat faces 823 of the rod portion 82 engage with the first and the second side walls 51, 52 of the engaging member 50 (as illustrated in FIG. 7) individually, hence the tilted angle among the first aperture 511, the second aperture 521, and the shaft member 40 is more that a set value so that the shaft member 40 only allows to move toward the first hole 14 without moving toward the chamber 13. Thereafter, the second body 21 is pressed toward the retaining position (donated by an arrow in FIG. 10) from the releasing position so that the notch 241 of the push piece 24 retains with a bottom end of the shaft member 40 as illustrated in FIG. 9, and the pushing springs 23 forces the push piece 24 to generate a retaining point R and a pushing angle $\alpha$ on the bottom end of the shaft member 40, the push piece 24 is pushed by the pushing springs 23 to abut against the shaft member 40, and the second body 21 is actuated to move the shaft member 40 at angles of 19 degrees, 11 degrees, and 3 degrees in order from the pushing angle $\alpha$ so as to push the push piece 24 outward completely, thus pushing the shaft member 40 forward. Because when the second body 21 moves toward the retaining position, the push piece 24 is pressed by the shaft member 40 gradually to press the pushing springs 23 so that the pushing springs 23 retain with the bottom end of the shaft member 40, and the shaft member 40 is pushed toward the first hole 14 for a predetermined axial distance so that the second retaining member 70 is actuated by the shaft member 40 to move away from the first retaining member 60.

Figure 11:
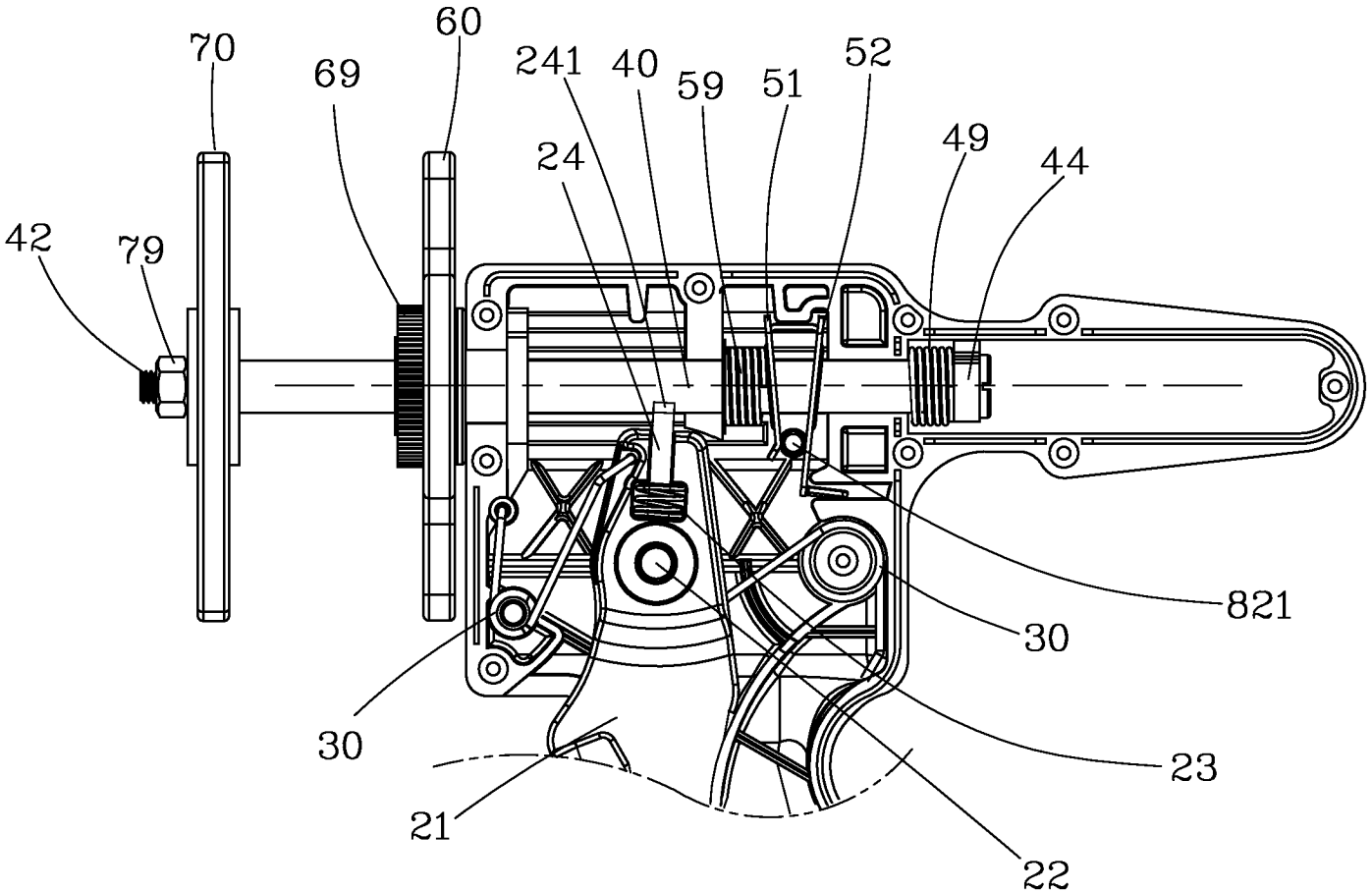
FIG. 11 is also another side plan view showing the operation of the removal and replacement tool for vehicles in accordance with the present invention.

If desiring the second retaining member 70 to move away from the first retaining member 60, the second body 21 is released so that the first returning springs 30 actuate the second body 21 to return back to the releasing position, and then the second body 21 is pressed toward the retaining position further so that the shaft member 40 moves to actuate the second retaining member 70 to move away from the first retaining member 60 (as shown in FIG. 11). Due to the second body 21 moves between the releasing position and the retaining position, the first and second apertures 511, 512 of the engaging member 50 keep at the tilted angle relative to the shaft member 40, accordingly the shaft member 40 is prevented from being moved toward the chamber 13 and only allows to move toward the first hole 14.

After finishing the maintenance of the vehicle, the rotating portion 81 of the rotary knob 80 is rotated toward a returning position (represented by a dotted line in FIG. 6) from the limiting position, and then the arcuate faces 824 abut against the first and the second side walls 51, 52 to expand a distance between the first and the second side walls 51, 52 (as shown in FIG. 8), such that the tilted angle among the first aperture 511, the second aperture 521, and the shaft member 40 is less than the set value. Thereby the shaft member 40 is pushed by the second spring 49 to move toward the chamber 13 so that the second retaining member 70 engages with the first retaining member 60 tightly, lowering a store size.

Therefore, the second body 21 is pressed to push the shaft member 40 to move outward so that the second retaining member 70 moves away from the first retaining member 60, operating the removal and replacement tool 100 easily and quickly.

The rotating portion 81 of the rotary knob 80 is rotated toward the returning position so that the second spring 49 pulls the shaft member 40 backward quickly, thereby returning the shaft member 40 easily.

While we have shown and described various embodiments in accordance with the present invention, it is clear to those skilled in the art that further embodiments may be made without departing from the scope of the present invention.

What is claimed is:

1. A removal and replacement tool for vehicles comprising:

a first body including a chamber, a first hole disposed on one side thereof, a second hole fixed on a bottom end thereof, and a third hole formed thereon;

a grip set including a second body and a push piece, and one side of the second body being axially fixed in the chamber of the first body, another side of the second body being extended out of the first body from the second hole, and the push piece including an arcuate notch arranged on a top end thereof;

at least one first returning spring, one end of which abut against the first body, and another end of which abuts against the second body;

a shaft member disposed in the chamber of the first body, and its one end extending out of the first body from the first hole;

a second spring, one end of which abuts against the chamber of the first body, another end of which is biased against the shaft member so that when the shaft member is not forced, the second spring provides a predetermined pull force to the shaft member to move toward the chamber;

an engaging member including a first side wall and a second side wall, and the first side wall including a first aperture disposed thereon, the second side wall including a second aperture fixed thereon, wherein the engaging member is fixed in the chamber of the first body, and the first and the second apertures are used to insert the shaft member therein;

a first retaining member secured on the first body;

a second retaining member retained with the shaft member and actuated by the shaft member;

a rotary knob including a rotating portion and a rod portion connecting with the rotating portion, and the rotating section being located outsides the first body and forced to move between a retaining position and a limiting position, the rod portion including at least one flat face and at least one arcuate faces and being inserted into the chamber from the first hole of the first body.

2. The removal and replacement tool for vehicles as claimed in claim 1, wherein the grip set includes an axial stem and at least one pushing spring; the second body includes a bore to insert the axial stem therein, the pushing spring is disposed between the second body and the push piece to push the push piece.

3. The removal and replacement tool for vehicles as claimed in claim 1, wherein the first body includes two first returning spring, one end of each first returning spring is fixed in the chamber of the first body, and another end thereof abuts against two sides of the second body.

4. The removal and replacement tool for vehicles as claimed in claim 1, wherein the engaging member also includes a connecting wall to connect with the first side wall or the second side wall; and the rod portion of the rotary knob is located between the first and the second side walls.

5. The removal and replacement tool for vehicles as claimed in claim 1, wherein the chamber includes a third spring disposed therein, and one end of the third spring contacts with an inner surface of the chamber, another end thereof is biased against the first side wall of the engaging member so that when the first and the second apertures are located at a limiting position, a tilted angle among the first aperture the second aperture, and the shaft member is more that a set value so that the shaft member only allows to move toward the first hole without moving toward the chamber.

6. The removal and replacement tool for vehicles as claimed in claim 1, wherein the rod portion includes an acting section and a coupling section integrally connecting with the acting section, and the coupling section connects with the rotating portion, the acting section includes two symmetrical flat faces and two symmetrical arcuate faces.

* * * * *